United States Patent [19]

Minks

[11] Patent Number: 4,772,865

[45] Date of Patent: Sep. 20, 1988

[54] FLAT-TYPE POLARIZED RELAY

[75] Inventor: Werner Minks, Heroldsberg, Fed. Rep. of Germany

[73] Assignee: Standard Elektrik Lorenz AG

[21] Appl. No.: 114,872

[22] Filed: Oct. 30, 1987

[30] Foreign Application Priority Data

Oct. 31, 1986 [DE] Fed. Rep. of Germany ..... 3637115

[51] Int. Cl.[4] ..... H01H 51/22

[52] U.S. Cl. ..... 335/80; 335/85; 335/81

[58] Field of Search ..... 335/78, 79, 80, 81, 335/82, 83, 84, 85, 128, 124, 121, 126

[56] References Cited

U.S. PATENT DOCUMENTS

| | | | |
|---|---|---|---|
| 4,490,705 | 12/1984 | Mueller | 335/124 |
| 4,560,966 | 12/1985 | Nagamoto et al. . | |
| 4,563,663 | 1/1986 | Niekawa et al. | 335/79 |
| 4,587,501 | 5/1986 | Agatahama et al. . | |
| 4,621,246 | 11/1986 | Nagamoto et al. . | |

FOREIGN PATENT DOCUMENTS

| | | |
|---|---|---|
| 0117451 | 9/1984 | European Pat. Off. . |
| 0130423 | 1/1985 | European Pat. Off. . |
| 0157029 | 10/1985 | European Pat. Off. . |
| 0171808 | 2/1986 | European Pat. Off. . |
| 0118040 | 8/1986 | European Pat. Off. . |
| 0204199 | 12/1986 | European Pat. Off. . |
| 3320000 | 1/1984 | Fed. Rep. of Germany . |
| 3336872 | 4/1985 | Fed. Rep. of Germany . |
| 3535665 | 7/1986 | Fed. Rep. of Germany . |
| 3520773 | 10/1986 | Fed. Rep. of Germany . |
| 2166595 | 5/1986 | United Kingdom . |

OTHER PUBLICATIONS

Gebrauchmuster; Fed. Rep. of Germany; 8-16-79, "Elektromagnetisches Relais"; H01H 50-26; gm7909155.

*Primary Examiner*—E. A. Goldberg
*Assistant Examiner*—Lincoln Donovan
*Attorney, Agent, or Firm*—Spencer & Frank

[57] ABSTRACT

A flat-type polarized relay with contact springs disposed at the sides of a parallel to the coil system. A magnetic core projects beyond the coil form and cooperates with movable pole plates disposed together with a permanent magnet in a transversely movable cross slide. The magnet yoke is a U-shaped member made from flat material. The base of the yoke is rigidly connected with the magnetic core, and the legs run along the sides of the coil. The relay has a small overall height and a high switching capacity at small energizing currents.

23 Claims, 1 Drawing Sheet

FLAT-TYPE POLARIZED RELAY

DESCRIPTION

The present invention relates to a flat-type polarized relay as set forth in the preamble of claim 1.

A relay of this kind is disclosed in DE-OS 35 20 773. There the armature, which extends in the longitudinal direction of the coil, is an approximately H-shaped plate and is pivoted above the coil system. The cross slide is coupled with the armature so as to have play. The armature plate contains permanent magnets which are magnetized in the longitudinal direction of the coil. The yoke is passed with the long leg through the coil core and projects on both sides into the recesses of the H-shaped armature. In another embodiment, the armature is hinged inside the coil core.

A flat-type polarized relay with small dimensions in the vertical direction and with a contact unit which, seen from above, is located at the side of the coil assembly is disclosed in European Patent No. 0 117 451. There the armature is designed as a frame which encloses the coil assembly and is hinged in the middle of the coil assembly via lateral pins. The permanent magnets are disposed in the area of the pins, i.e., at the side of the coil assembly, and the contact units are mounted even further outside. The relay thus becomes relatively wide and, seen from above, is square in shape.

European Patent No. 0 118 040 discloses a small-size elongate relay whose overall height is approximately equal to the height of the coil assembly and in which the armature is hinged in a hollow coil core, projects at both ends, and extends on one or both sides into the space between two pole plates. The contacts are integrated in pole pieces.

The object of the present invention is to provide a relay of the above kind which, while having smaller overall dimensions, particularly a small overall height, has a high pull at minimum input power. Furthermore, the relay is to be easy to assemble despite consisting of uncomplicated, easy-to-produce parts. In addition, it is to be possible to make the relay washtight, and the relay is to be suitable for surface mounting using SMD technology.

This object is attained by the features set forth in claim 1. In the relay according to the invention, there is no pivoted or hinged armature whose support is always relatively complicated and costly. In addition, the legs of the yoke rest flat against the coil, so that only little space is required at the side, and thanks to the lateral arrangement of the legs, the overall height can be approximately equal to that of the coil, i.e., small. By placing the magnetic core in the coil core, optimum magnetic flux is achieved, and by the special arrangement of the poles and the projecting ends of the core and the legs and by the choice of the distances between the same, a good closure of the magnetic circuit is achieved when the relay is held in its energized or deenergized position. Thus, high contact pressure can be achieved. Finally, the bearing for the cross slide is uncomplicated, because simple lugs integrally formed on a bottom member and/or a cover member are sufficient for this purpose. The fit of this bearing need not be as accurate as that of a pivot bearing.

Further advantageous details of the invention are set forth in the subclaims and will now be described with the aid of the embodiments illustrated in the accompanying drawing, in which:

Figure 1:
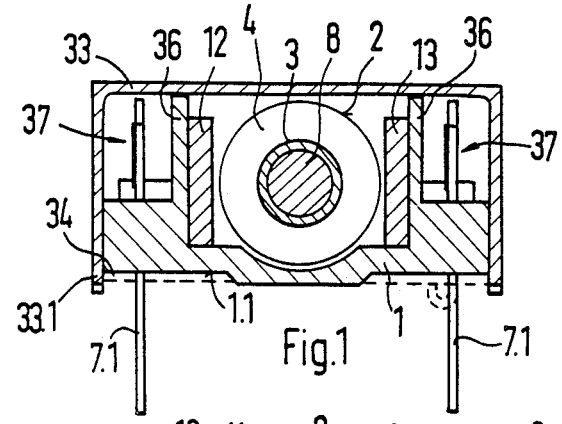
FIG. 1 is a sectional front view of a relay.

The reference numeral 1 denotes a bottom member in the form of a plate on which is mounted a coil system consisting of a coil form 2, a coil 4 wound on the hollow coil core 3, and connecting pins 6 fixed in a coil flange 5. The pins 6 project outwardly (7) through openings of the bottom member 1.

The hollow coil core 3 contains a magnetizable core 8 of a magnet system; the core 8 is preferably inserted or pressed in. To obtain a maximum magnetic flux with minimum dimensions, the core 8 is preferably circular in section. Attached to the core end 9 projecting at the coil flange 5 is the base 11 of a U-shaped yoke 10 made from flat material. Seen from above, the flat legs 12, 13 of the yoke 10 extend along the sides of the coil 10 in the direction of the longitudinal axis L of the coil. The free ends 14, 15 of the legs 12, 13 and the free end 16 of the coil 8 project beyond the coil flange 17 opposite the first-mentioned coil flange 5. Between each of the leg ends 14, 15 and the free core end 16, there is a space 18, the distance between the opposite parts being designated A.

At the front side 19 of the free core end 16, a cross slide 20 is movable transversely to the longitudinal axis L of the coil. It is provided with two openings 21 extending in the direction of the longitudinal axis L of the coil. In each opening 21, the end portion of a pole plate 22 of magnetizable material is held, e.g., pressed in, glued in, molded in, etc. At its outer wall 23, the cross slide 20 has a transverse slot 24, which extends from one opening 21 to the other. In the cross slot 24, a permanent magnet 25 is so positioned, e.g., pressed in and/or glued in, that each of its magnetic poles rests against one of the pole plates 22. The two pole plates 22 are therefore magnetically polarized in opposite directions.

The distance A between the core end and the respective leg end 14, 15 is equal to the thickness D of a pole plate 22 plus the armature travel H, and the distance between the two pole plates 22 is equal to the width B of the core end 16 plus the armature travel H.

The pole plates 22 and the permanent magnet 25 thus form the armature of the relay's magnet system.

At each of its lateral ends, the cross slide 20 has a slot 26, in which a contact spring 27 is guided. Each of the contact springs 27 carries a double contact 28, and each of these contacts faces a fixed contact member 29, 30. Each of these contact systems 28, 29, 30 forms a transfer contact, and depending on the position of the cross slide 20, one contact is closed and the other is open. The ends 31 of the contact springs preferably project beyond the contacts 28 and into the slots 26. This permits the cross slide 20 to be easily fitted from the front side of the relay.

The contact springs 27 extend beside the legs 12, 13 of the yoke 10 in spaced relationship therefrom, and each of them is fastened to a contact pin 32 in the area of the coil flange 5 remote from the cross slide 20.

The contact pins 32 are passed through the bottom member 1, the outwardly projecting portions being designated 7.1. Likewise, contact can be made to the contact members 29, 30 via terminals 7.2, 7.3 extending through the bottom member 1.

A preferably cup-shaped cover member 33 can be slipped over the bottom member 1. The rim 33.1 of the cover member 33 projects beyond the outside 1.1 of the bottom member 1 by such a distance that the resulting space can be filled with a sealing compound 34, such as a compound based on self-curing synthetic resin.

The cover member 33 also serves to guide the cross slide 20 as the inside of one end wall 33.2 and the inside of the upper portion 33.3 of the cover act as guiding surfaces. Instead or in addition thereto, the bottom member 1 and/or the cover member 33 may be provided with lugs 1.2, 33.4 which permit only a transverse movement of the cross slide 20. The height of the cross slide 20 is preferably nearly equal to the clearance between the inside of the upper portion 33.3 of the cover and the inside of the bottom member 1.

According to a further advantageous feature of the invention, a wall portion 36 is provided parallel to and preferably close to each of the legs 12, 13. It extends in length from the cross slide 20 to the remote coil flange 5, and in height from the inside of the bottom member 1 to the inside of the upper portion 33.3 of the cover. The wall portions 36 are preferably formed integrally with the bottom member 1 or the cover member 33. By these wall portions 36, switching chambers 37 for the contact systems are formed in the relay which are practically completely separated from the remainder of the relay structure.

Figure 4:
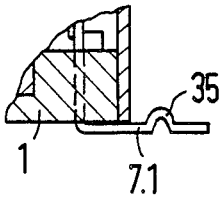
FIGS. 4 to 7 show possible styles of the terminals.
Figure 5:
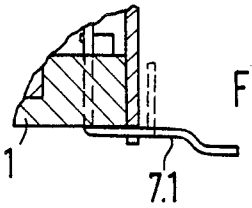
Figure 2:
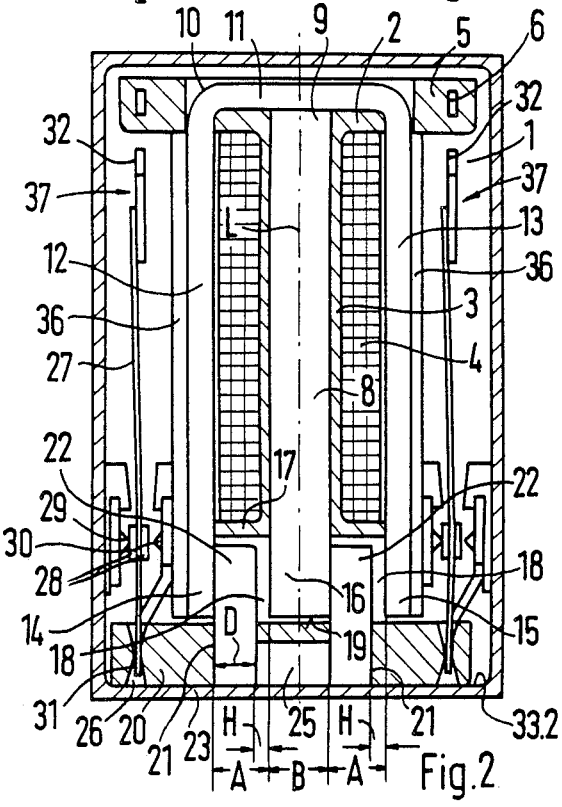
FIG. 2 is a sectional top view of the relay of FIG. 1.
Figure 3:
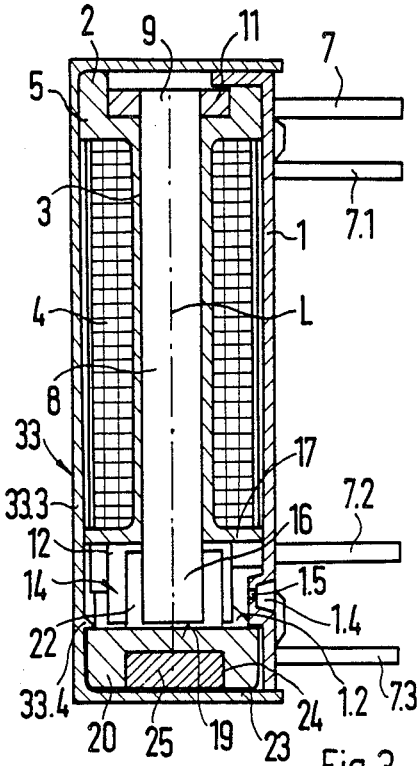
FIG. 3 is a sectional side view of the relay of FIG. 1.
Figure 6:
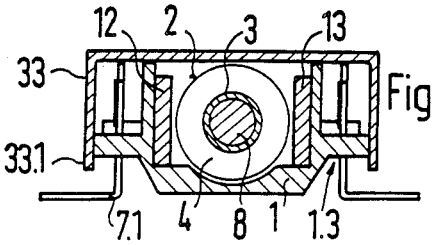
Figure 7:
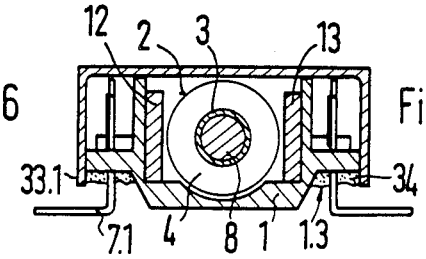

The terminals 7, 7.1, 7.2, and 7.3 are preferably arranged in the so-called dual-in-line configuration. They may be designed for surface mounting using SMD technology, i.e., in such a way that the relay can be mounted and soldered on the surface of a circuit board. To this end, they may be bent inwards, as indicated by broken lines in FIG. 1, or outwards, as shown in FIGS. 4 to 7. They may be provided with an upward upset 35 as shown in FIG. 4, bent downwards in the form of a Z as shown in FIG. 5, or bent outwards after a straight portion as shown in FIGS. 6 and 7.

According to a further advantageous feature of the invention, at least the outside 1.1 of the bottom member 1, seen in the direction of the longitudinal axis L of the coil, i.e., in a section perpendicular to this axis, has the shape of a tray. In the resulting recessed lateral rim areas 1.3, the terminals 7, 7.1, 7.2, and 7.3 protrude from the bottom member 1, and the rim 33.1 of the cover member 33 projects beyond these rim areas at least slightly, so that these rim areas 1.3 can be filled with a sealing compound 34.

According to another advantageous of the invention, the cover member 33 or preferably the bottom member 1 is provided with an inwardly directed, preferably cup- or funnel-shaped recess 1.4 having an opening 1.5 in its bottom. Through this opening, the relay is degassable and/or can be filled with a filler gas, and subsequently the relay can be sealed by filling the recess 1.4 with a drop of a sealing compound.

I claim:

1. Flat-type polarized relay comprising a coil system, two contact systems each disposed on one side of and parallel to the coil system, a cross slide which is movable perpendicular to the coil system and to contact springs of the contact systems, is coupled with a transversely movable armature consisting of two parallel pole plates, and cooperates with the contact springs, and a permanent magnet for magnetizing the pole plates to move the armature in the direction determined by the control current of the coil of the coil system and for holding this armature in the position assumed, the pole plates extending parallel to the longitudinal axis of the coil, and the free end of the magnetic core being located between the pole plates so that the pole plates have a play corresponding to the armature travel, characterized by the following features:

(a) The free core end (16) projects beyond the flange (17) of the coil form (2) and extends into the space between the pole plates (22);

(b) the yoke (10) is a U-shaped member made from flat material having its base (11) permanently connected with the end (9) of the core (8) opposite the projecting core end (16), and each of its two legs (12, 13) runs along one side of the coil system (2, 4, 6);

(c) the leg ends (14, 15), too, project beyond the front end of the flange (17) of the coil form (2);

(d) the cross slide (20) is disposed at the front side (19) of the core end (16);

(e) the two pole plates (22) are held at one end portion thereof in the cross slide (20) and are coupled by the magnetic force of the permanent magnet (25), which is contained in the cross slide (20);

(f) the free end of each of the pole plates (22) projects into an associated space (18) between the core end (16) and the adjacent leg end (14, 15);

(g) the distance (A) between the core end (16) and the respective leg end (14, 15) is equal to the thickness of the pole plate (22) plus the travel (H) of the armature (22, 25), and (h) the distance between two pole plates (22) is equal to the width (B) of the core end (16) plus the travel (H) of the armature (22, 25).

2. A relay as claimed in claim 1, characterized in that the maximum inner overall height of the relay is equal to the height of the coil system (2, 4, 6).

3. A relay as claimed in claim 1, characterized in that each of the contact springs (27) engages a slot (26) of the cross slide (20).

4. A relay as claimed in claim 3, characterized in that the movable contacts (28) are located back from the end (31) of the respective contact spring.

5. A relay as claimed in claim 1, characterized in that the contact system (28, 29, 30) of each of the contact springs (27) is designed as a transfer-contact system.

6. A relay as claimed in claim 1, characterized in that the contact system (28, 29, 30) is disposed at the side of the cross slide (20), and that the fixed point and the connection point of the contact spring (27) are located at the end of the contact spring (27) remote from the cross slide (20).

7. A relay as claimed in claim 1, characterized in that the terminals (7 1, 7.2, 7.3) of the contact system (28, 29, 30) are fixed in a bottom member (1), and that the terminals (7) of the coil (4) are fixed in the coil flange (5) remote from the cross slide (20) and brought out through openings in the bottom member (1).

8. A relay as claimed in claim 4, characterized in that the cross slide (20) can be slipped over the contact-spring ends (31) from the front side (19) of the core (16), that a cover member (33) can be placed on the bottom member (1), and that the cover member (33) forms the guide surface for the cross slide (20) at the front side and the top side of the relay.

9. A relay as claimed in claim 1, characterized in that lugs (1.2; 33.4) which allow only a transverse movement of the cross slide (20) are formed on the bottom member (1) and/or on the cover member (33).

10. A relay as claimed in claim 1, characterized in that the height of the cross slide (20) is nearly equal to the clearance between the inside of the cover member (33) and the inside of the bottom member (1).

11. A relay as claimed in claim 1, characterized in that the cross slide (20) has two openings (21) which extend in the longitudinal direction (L) of the coil (4) and in which the pole plates (22) are mounted, and that on the outside (23) of the cross slide (20), there is a cross slot (24) which extends from one of said openings (21) to the other and in which the permanent magnet (25) is positioned so that each of its magnetic poles rests against one of the pole plates (22).

12. A relay as claimed in claim 1, characterized in that the outwardly projecting terminals (7, 7.1, 7.2, 7.3) protrude from the bottom member (1) in a dual-in-line configuration.

13. A relay as claimed in claim 1 characterized in that parallel to each of the legs (12, 13) of the yoke (10), there is provided a wall portion (36) extending in length from the cross slide (20) to the opposite coil flange (5) and in height from the inside of the bottom member (1) to the inside of the cover member (33).

14. A relay as claimed in claim 13, characterized in that the wall portions (26) are formed integrally with the bottom member (1).

15. A relay as claimed in claim 13, characterized in that the wall portions (36) rest against the respective legs (12, 13).

16. A relay as claimed in claim 1, characterized in that the rim (33.1) of the cover member (33) projects beyond the bottom member (1), and that the bottom member (1) is sealed from outside with a sealing compound (34).

17. A relay as claimed in claim 1, characterized in that the terminals (7, 7.1, 7.2, 7.3) are bent to the side, and that the bent portions form solder terminals.

18. A relay as claimed in claim 17, characterized in that the terminals (7, 7.1, 7.2, 7.3) are bent over inwardly (FIG. 1).

19. A relay as claimed in claim 17, characterized in that the terminals (7, 7.1, 7.2, 7.3) are bent outwardly.

20. A relay as claimed in claim 19, characterized in that the outwardly bent portion is bent downwardly in the form of a Z.

21. A relay as claimed in claim 19, characterized in that the outwardly bent portion has an upwardly directed offset.

22. A relay as claimed in claim 18, characterized in that, in a section perpendicular to the longitudinal axis (L) of the coil, at least the outside (1.1) of the bottom member (1) has the shape of a tray, while in the recessed rim areas (1.3), the terminals (7, 7.1, 7.2, 7.3) protrude from the bottom member (1), that the rim (33.1) of the cover member (33) projects beyond said rim areas (1.3), and that said rim areas (1.3) are sealed from outside with a sealing compound (34).

23. A relay as claimed claim 1, characterized in that the core (8) is circular in section.

* * * * *